United States Patent [19]

Kamiwano et al.

[11] Patent Number: 4,919,347

[45] Date of Patent: Apr. 24, 1990

[54] DISPERSING AND GRINDING APPARATUS

[75] Inventors: Mitsuo Kamiwano, Yokohama; Yoshitaka Inoue, Tokyo, both of Japan

[73] Assignee: Inoue Seisakusho (Mfg) Co., Ltd., Japan

[21] Appl. No.: 290,314

[22] Filed: Dec. 27, 1988

[30] Foreign Application Priority Data

Dec. 28, 1987 [JP] Japan ..... 62-329959

[51] Int. Cl.[5] ..... B02C 17/16; B02C 17/18

[52] U.S. Cl. ..... 241/65; 241/174; 241/181

[58] Field of Search ..... 241/65, 66, 67, 179, 241/181, 172, 173, 174

[56] References Cited

U.S. PATENT DOCUMENTS

| | | | |
|---|---|---|---|
| 2,822,987 | 2/1958 | Uhle | 241/172 |
| 3,199,792 | 8/1965 | Norris, Jr. | 241/179 X |
| 3,993,254 | 11/1976 | Ricih et al. | 241/172 X |
| 4,059,232 | 11/1977 | Engels | 241/172 X |
| 4,206,879 | 6/1980 | Geiger | 241/172 X |
| 4,673,134 | 6/1987 | Barthelmess | 241/172 X |

FOREIGN PATENT DOCUMENTS

| | | | |
|---|---|---|---|
| 7431142 | 3/1976 | Fed. Rep. of Germany | 241/172 |

*Primary Examiner*—Timothy V. Eley
*Attorney, Agent, or Firm*—Bruce L. Adams; Van C. Wilks

[57] ABSTRACT

A dispersing and grinding apparatus comprises a vessel having an inlet at one end for supplying material which is to be ground and dispersed, and an outlet at the other end to discharge the ground and dispersed material. A rotor is rotatably disposed within the vessel and coacts with the inner wall of the vessel to define therebetween a narrow annular flow path through which the material flows from the inlet to the outlet of the vessel. An array of guide members are formed on the inner wall of the vessel or on the outer peripheral surface of the rotor for guiding the flow of the material-grinding medium mixture so that the predominant flow of the mixture in the narrow annular flow path occurs in the circumferential direction. The guide members have forward and rearward guide surfaces for imparting forward and rearward motions to the mixture as it flows circumferentially about the annular flow path. As the predominant mixture flow is in the circumferential direction, sufficient motion is imparted to the mixture to enable the grinding medium to grind and uniformly disperse the material as the material advances in the lengthwise direction through the narrow flow path to the outlet of the vessel.

17 Claims, 2 Drawing Sheets

DISPERSING AND GRINDING APPARATUS

BACKGROUND OF THE INVENTION (1) Field of the Invention

The present invention relates generally to an apparatus for mixing and dispersing materials, and more particularly to an apparatus for dispersing and grinding materials by means of a particulate grinding medium.

(2) Background Information

Generally, a conventional dispersing and grinding apparatus employs a rotary agitator, such as discs, flights, stirring rods or the like, disposed within a vessel. In use, a material which is to be dispersed and ground is charged into the vessel through an inlet. A particulate grinding medium is added to the vessel and assists in grinding the material in conjunction with the rotating action of the agitator. As the agitator rotates, the mixture of material and grinding medium is agitated and advanced lengthwise through the vessel while mixing and dispersing the material. The dispersed and ground material is discharged through an outlet at the other end of the vessel, and the grinding medium is separated from the material and retained within the vessel for re-use.

In this type of apparatus, the mixture consisting of the grinding medium and the material flows lengthwise through the vessel at a relatively high velocity gradient, and the flow velocity of the mixture at the downstream end near the outlet is higher than at the upstream end near the inlet. As a consequence, the material often reaches the outlet before being sufficiently ground and dispersed. This problem is further aggravated by the tendency of the grinding medium to gather at the downstream end of the vessel so that an insufficient quantity of grinding medium is present throughout the length of the vessel to attain uniform dispersion of the material.

SUMMARY OF THE INVENTION

One object of the present invention is to provide a dispersing and grinding apparatus which overcomes the aforementioned problems prevalent in conventional dispersing and grinding apparatus.

Another object of the present invention is to provide a dispersing and grinding apparatus which avoids the formation of high velocity gradients in the flow of the material-grinding medium mixture lengthwise through the apparatus.

A further object of the present invention is to provide a dispersing and grinding apparatus in which the lengthwise flow of the material-grinding medium mixture approximates that of a plug flow, i.e., the material advances lengthwise more or less as a bulk, thereby preventing formation of high velocity gradients in the lengthwise flow direction.

A still further object of the present invention is to provide a dispersing and grinding apparatus in which the predominant flow of the material-grinding medium mixture is in the circumferential direction thereby ensuring sufficient interaction between the grinding medium and the material to attain uniform mixing and dispersing of the material during its advancement in the lengthwise direction through the apparatus.

Another object of the present invention is to provide a dispersing and grinding apparatus wherein the material-grinding medium mixture flows through a narrow flow path in which the predominant motion of the mixture is in the circumferential direction to thereby attain uniform mixing and dispersing of the material.

A further object of the present invention is to provide a dispersing and grinding apparatus which has an improved dispersion efficiency as compared to comparable prior art apparatuses.

These as well as other objects of the invention are attained by a dispersing and grinding apparatus comprised of a vessel having an inlet at one end for supplying material which is to be ground and dispersed and having an outlet at the other end to discharge the ground and dispersed material. A rotor is rotatably disposed within the vessel and coacts with the inner wall of the vessel to define therebetween a narrow annular flow path through which the material flows from the inlet to the outlet of the vessel. An array of guide members are formed on the inner wall of the vessel or on the outer peripheral surface of the rotor for guiding the flow of the material-grinding medium mixture so that the predominant flow of the mixture in the narrow annular flow path occurs in the circumferential direction. As the predominant mixture flow is in the circumferential direction, sufficient motion is imparted to the mixture to enable the grinding medium to grind and uniformly disperse the material as the material advances in the lengthwise direction through the narrow flow path to the outlet of the vessel.

Other objects and features of the present invention will become apparent to persons of ordinary skill in the art upon a reading of the following description of the invention with reference to the accompanying drawings.

DESCRIPTION OF THE PREFERRED EMBODIMENTS

The present invention is applicable to both horizontal-or vertical-type dispersing and grinding apparatus. In the following description, reference will be made to a horizontal-type apparatus, and it is understood that the principles of the invention can likewise be applied to a vertical-type dispersing and grinding apparatus.

Figure 1:
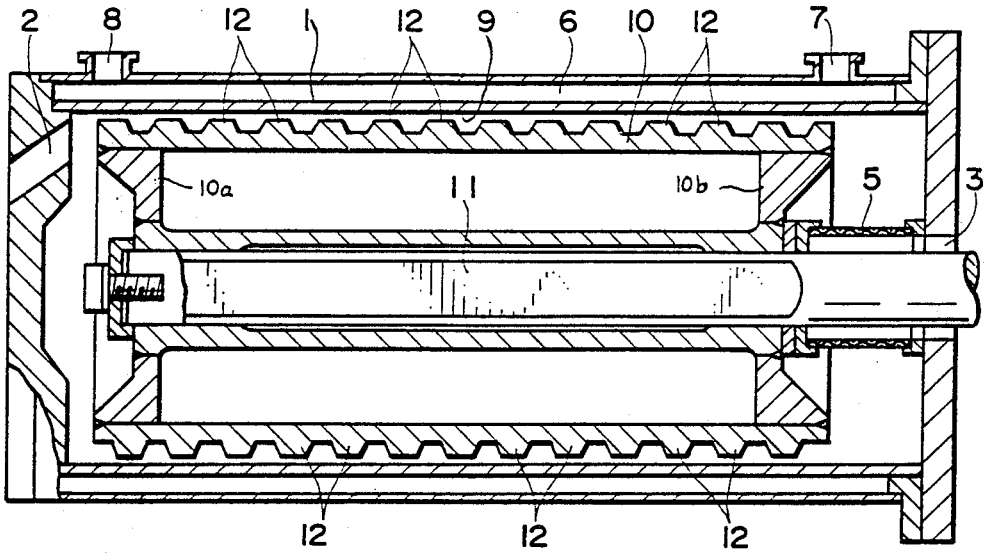
FIG. 1 is a cross-sectional side view of one embodiment of a dispersing and grinding apparatus constructed according to the principles of the present invention.
Figure 2:
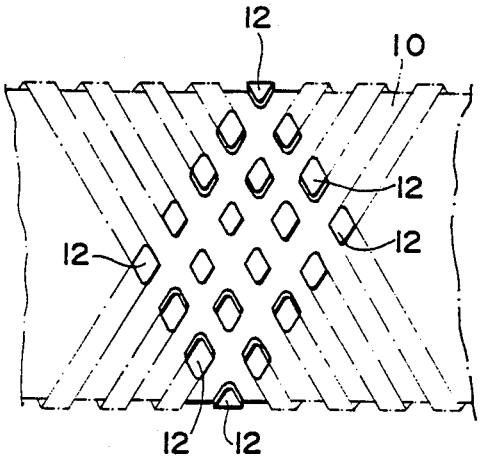
FIG. 2 is an explanatory side view showing a portion of the outer peripheral surface of the rotor of the dispersing and grinding apparatus shown in FIG. 1.
Figure 3:
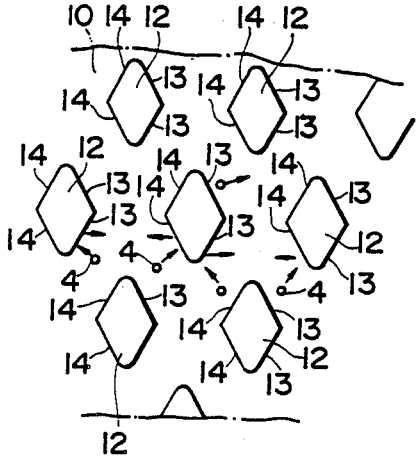
FIG. 3 is an enlarged explanatory view of the guide members formed on the outer peripheral surface of the rotor of the dispersing and grinding apparatus shown in FIG. 1.

FIGS. 1–3 show one embodiment of a horizontal-type dispersing and grinding apparatus. The apparatus comprises a vessel 1 having a generally cylindrical shape having closed opposite ends. An inlet 2 is provided at one end of the vessel 1 for admitting a material which is to be dispersed and ground, and an outlet 3 is provided at the other end of the vessel 1 for discharging the ground, dispersed material. A grinding medium is contained within the vessel 1 and, as explained hereinafter, functions to grind the material as it flows circumferentially and axially through the vessel 1. The grinding medium may comprise balls, beads or other suitable particulates composed of, for example, glass, ceramic, alumina, zirconium, steel and the like, and the choice of grinding medium will depend on the characteristics of the material being processed and the type of processing to be done. A separator 5 is disposed at the downstream end of the vessel 1 adjacent the outlet 3 for separating the processed material from the grinding medium. In this embodiment, the separator 5 comprises a screen-type separator which has a mesh size sufficient to permit the processed material to pass therethrough but which prevents passage of the grinding medium thereby retaining the grinding medium within the vessel 1 for re-use. Alternatively, a gaptype separator may be utilized.

The vessel 1 is surrounded by an annular jacket 6 which may be used to circulate a fluid cooling medium, heating medium, insulating medium or the like. The fluid medium is introduced into the jacket 6 through an inlet 7 and is discharged from the jacket 6 through an outlet 8. In this manner, the fluid medium circulating through the jacket 6 can be used to control the temperature of the material being processed within the vessel 1. Alternatively, the jacket 6 may be disposed interiorly within the vessel 1.

A rotor 10 is mounted to undergo rotation within the vessel 1. The rotor 10 has a generally cylindrical shape and is closed at opposite ends by flanges **10*a*,10*b*. The rotor flanges 10*a*, 10*b* are secured to a drive shaft 11 which is rotationally driven during use of the apparatus by suitable driving means (not shown) to thereby effect rotation of the rotor 10. In this embodiment, the rotor 10 is directly rotationally driven by the drive shaft 11 which extends outside of the vessel 1. Alternatively, the rotor 10 may be indirectly rotationally driven by electromagnetic inductive action generated by a rotating magnetic field. In this alternative arrangement, the rotating magnetic field can be created by sequentially energizing a series of electromagnetic coils disposed circumferentially around the vessel 1 such as disclosed in U.S. Pat. No. 4,729,664 to Kamiwano and Inoue, or by rotating a set of permanent magnets positioned inside of the rotor 10 or outside of the vessel 1. The rotating magnetic field interacts with a set of permanent magnets affixed to the rotor 10 or with a magnetic portion of the rotor 10** to induce rotation of the rotor in accordance with the rotating magnetic field.

As best shown in FIGS. 2 and 3, an array of guide members 12 are formed as protrusions on the peripheral surface of the rotor 10. The guide members 12 have a generally diamond shape defined by two pairs of opposed, parallel side surfaces. As viewed from above, the guide members 12 are configured as a parallelogram. As shown in FIG. 2, the parallelogrammatic guide members 12 are positioned at the points of intersection of imaginary left-hand and right-hand helices such that one pair of parallel sides is parallel to the left-hand helical axis and the other pair of parallel sides is parallel to the right-hand helical axis. In this manner, the guide members 12 are disposed in a uniform and evenly distributed pattern on the surface of the rotor 10. As shown in FIG. 3, each parallelogrammatic guide member 12 has a pair of forward guide surfaces 13 which face the vessel outlet 3 and a pair of rearward guide surfaces 14 which face the vessel inlet 2. As explained in more detail hereinafter, the forward guide surfaces 13 impart a generally forward motion to the mixture consisting of the material and grinding medium, whereas the rearward guide surfaces 14 impart a generally rearward motion to the mixture, in accordance with the rotation of the rotor 10.

The guide members 12 are preferably formed as one integral body with the rotor 10. For example, the guide members 12 may be formed in the surface of the rotor by machining or any other mechanical processing, or can be formed by casting at the time of forming the rotor. While the guide members 12 are shown as having a generally diamond shape, the guide members may have other configurations, such as oval or circular or other suitable shape. Alternatively, the guide members 12 may be formed as concavities rather than protrustions. Further, the guide members 12, whether they be protrustions or concavities, may be formed on the inner wall 9 of the vessel 1 instead of on the periphery of the rotor 10.

As shown in FIG. 1, the dimensions of the vessel 1 and the rotor 10 are selected to define a narrow, annular flow path between the vessel inner wall 9 and the peripheral outer surface of the rotor 10. The guide members 12, which are formed as protrustions on the rotor 10 in this embodiment, protrude into the narrow flow path and function to positively assist the flow of the mixture of the material and grinding medium in the circumferential direction around the annular, narrow flow path in response to rotation of the rotor 10. By suitably selecting the pitch of the guide members 12, it is possible to control the flow of the mixture to avoid the occurrence of a high velocity gradient in the axial lengthwise direction of the vessel 1 so that the flow of the mixture approximates that of a plug flow.

During operation of the embodiment shown in FIGS. 1–3, a suitable grinding medium 4 is introduced through the inlet 2 into the vessel 1 and distributed more or less equally along the length of the rotor 10. The material to be processed (not shown) is introduced under a forward pressure through the inlet 2 into the vessel 1 by means of a pump (not shown), and the rotor 10 is rotationally driven. As the rotor 10 rotates, the mixture of grinding medium 4 and material is directed lengthwise through the annular, narrow flow path toward the outlet 3. In the course of rotation of the rotor 10, the mixture strikes the forward guide surfaces 13 of the guide members 12, as shown in FIG. 3, and this impact with the forward guide surfaces 13 imparts a generally forward motion to the mixture in a direction toward the outlet 3. The mixture also strikes the rearward guide surfaces 14, and this impact imparts a generally rearward motion to the mixture in the direction toward the inlet 2. As the rotor 10 rotates, the mixture randomly strikes the forward and rearward guide surfaces 13,14 of the guide members 12 and as a result, the mixture is agitated and circulated in different directions but overall, the mixture tends to circulate circumferentially around the narrow flow path due to the rotating motion of the guide members 12. The material is subjected to a uniform shearing force by the cooperative actions of the guide members 12 and the grinding medium 4 as the material flows circumferentially along the annular, narrow flow path thereby ensuring uniform mixing and dispersing of the material. As the material flows in the circumferential direction, it randomly strikes the forward and rearward guide surfaces 13,14 so that the material tends to circulate circumferentially within the same limits in the axial direction of the rotor 10 so that the overall axial forward flow of the material is similar to that of a plug flow. In this manner, the forwardly flowing material does not exhibit a high velocity gradient in the axial direction thereby promoting efficient and uniform intermixing and dispersing of the material. In addition, the combined effects of the oppositely facing forward and rearward guide surfaces 13,14 are effective to prevent the accumulation of the grinding medium at the upstream and downstream ends of the vessel 1 thereby ensuring that a sufficient quantity of grinding medium is present throughout the length of the vessel 1 to attain uniform dispersion of the material.

It has been confirmed by experimentation that the apparatus constructed according to the embodiment shown in FIGS. 1–3 exhibits a mixture flow which approximates that of a plug flow. In the apparatus used in these experiments, the guide members 12 extended about 4mm above the surface of the rotor 10, the vessel inner wall 9 was spaced about 4mm above the level of the guide members 12, and the grinding medium was about 0.8mm–lmm in diameter.

The distance between the top surfaces of the guide members 12 and the vessel inner wall 9 should preferably be at least four times greater than the average diameter of the particulates constituting the grinding medium. Thus the spacing distance is suitably selected in accordance with the particular size of the grinding medium.

Figure 4:
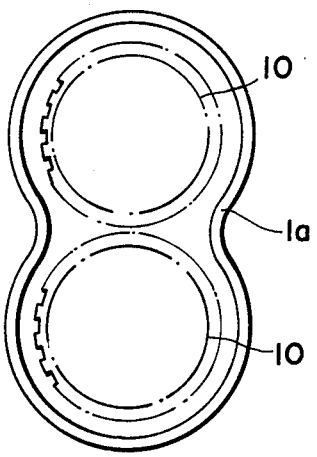
FIG. 4 is a diagrammatic end view of a second embodiment of a dispersing and grinding apparatus constructed according to the principles of the present invention.

In the embodiment shown in FIGS. 1–3, the rotor 10 has a cylindrical configuration. However, the rotor is not limited to a cylindrical configuration, and other rotor configurations may be used Further, as shown in the FIG. 4 embodiment, a plurality of rotors 10 may be disposed in parallel within a common vessel 1*a*. In this modified embodiment, the inner wall of the vessel la encircles the plural rotors 10,10 so as to form a continuous flow path around the rotors to carry out the grinding, mixing and dispersing of the material.

Figure 5:
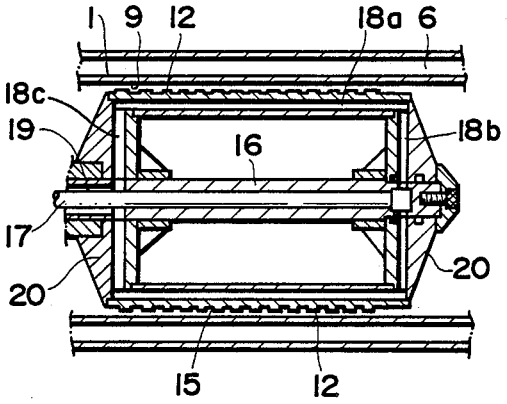
FIG. 5 is a cross-sectional side view of a third embodiment of a dispersing and grinding apparatus constructed according to the principles of the present invention.

In the embodiment shown in FIG. 5, a second jacket is provided within the rotor in addition to the jacket 6 employed in the first embodiment. In this embodiment, a cylindrical rotor 15 is rotatably mounted within a vessel 1 provided with an outer jacket 6. An inner jacket is formed within the rotor 15 for circulating a fluid medium in close proximity to the peripheral surface of the rotor.

The inner jacket comprises an annular passage 18*a* which extends circumferentially around the rotor 15 adjacent the peripheral surface of the rotor. A supply conduit 17 extends through a shaft 16 of the rotor 15 and supplies a fluid medium to the annular passage 18*a* through a feed passage 18*b* formed in one end 20 of the rotor 15. Another feed passage 18*c* is provided at the other end 20 of the rotor 15 for discharging the fluid medium through an outlet 19. By such a construction, a fluid medium introduced through the supply conduit 17 is circulated through the feed passage 18*b*, the annular passage 18*a* and the feed passage 18*c* to the discharge outlet 19. The circulating fluid medium, such as water or the like, effects indirect heat exchange with the material being processed through the peripheral wall of the rotor 15. In addition, the material being processed also undergoes heat exchange with the fluid medium circulating through the jacket 6. This embodiment enables precise temperature control of the material being processed. Further, as shown in FIG. 5, the ends 20,20 of the rotor 15 have conical surfaces to assist in guiding the mixture toward the narrow flow path between the vessel inner wall 9 and the peripheral surface of the rotor 15 and to facilitate removal of the processed material from the narrow flow path.

In accordance with the dispersing and grinding apparatus of the present invention, the mixture of the material and grinding medium flows through a narrow, annular flow path formed between the inner wall of the vessel and the outer periphery of the rotor, and the array of guide members formed on the rotor surface or the inner wall of the vessel coact with the grinding medium to apply sufficient shearing forces to the material during rotation of the rotor to effect uniform mixing and dispersing of the material during its lengthwise advancement through the vessel. The material advances lengthwise through the vessel without formation of high velocity gradients in the lengthwise direction, and the lengthwise flow of the material approximates that of a plug flow. This ensures that the material is subjected to sufficient agitating action by the rotating guide surfaces and sufficient grinding action by the grinding medium to effect uniform mixing and dispersing of the material so that the finished ground material has a uniform particle size distribution.

Though the preferred embodiments of the apparatus of the invention have been described in connection with a dispersing and grinding apparatus, the principles of the invention are also applicable to wet-type grinders, mixers and other dispersing and mixing apparatuses.

What is claimed is:

1. A dispersing and grinding apparatus comprising: a vessel for receiving a material to be processed and a grinding medium, the vessel having an inlet at an upstream end for admitting the material into the vessel and an outlet at a downstream end for discharging processed material from the vessel; a rotor mounted to undergo rotation within the vessel and being positioned relative to the vessel to define an annular flow path between an inner wall of the vessel and the outer peripheral surface of the rotor; and guiding means disposed on one of the rotor peripheral surface and the vessel inner wall for guiding the flow of the mixture of material and grinding medium in the circumferential direction about the annular flow path in conjunction with lengthwise flow of the material along the flow path from the vessel inlet to the vessel outlet in response to rotation of the rotor to thereby attain grinding of the material by the grinding medium and uniform dispersing of the ground material, the guiding means including an array of forward guide surfaces positioned and configured to impart forward motion to the mixture in response to rotation of the rotor and an array of rearward guide surfaces positioned and configured to impart rearward motion to the mixture in response to rotation of the rotor, the forward and rearward guide surfaces being substantially linear surfaces lying along imaginary helices.

2. A dispersing and grinding apparatus according to claim 1; wherein the forward and rearward guide surfaces are arranged to effect random flow of the mixture in both the rearward direction toward the vessel inlet and in the forward direction toward the vessel outlet as the mixture flows circumferentially about the flow path.

3. A dispersing and grinding apparatus according to claim 2; including a plurality of similar rotors disposed in parallel within the vessel and spaced from the inner wall of the vessel to define therebetween a continuous annular flow path which encircles all of the rotors.

4. A dispersing and grinding apparatus according to claim 1; wherein the forward and rearward guide surfaces are distributed in a uniform pattern.

5. A dispersing and grinding apparatus according to claim 1; including heat exchanging means disposed interiorly of the rotor for controlling the temperature of the material being processed through indirect heat exchange.

6. A dispersing and grinding apparatus according to claim 1; wherein the guiding means comprises a plurality of guide members, each guide member having at least one forward guide surface and at least one rearward guide surface.

7. A dispersing and grinding apparatus according to claim 6; wherein each guide member has a generally diamond shape comprised of two pairs of opposed, parallel guide surfaces, one guide surface of each pair being a forward guide surface and the other guide surface of each pair being a rearward guide surface.

8. A dispersing and grinding apparatus according to claim 7; wherein the guide members comprise protrusions protruding outwardly from one of the rotor peripheral surface and the vessel inner wall.

9. A dispersing and grinding apparatus according to claim 8; wherein the guide member protrusions protrude outwardly from the rotor peripheral surface.

10. A dispersing and grinding apparatus according to claim 9; wherein the rotor has a generally cylindrical shape and the guide member protrusions protrude outwardly from the cylindrical peripheral surface of the rotor.

11. A dispersing and grinding apparatus according to claim 1; including heat exchanging means disposed exteriorly of the vessel inner wall for controlling the temperature of the material being processed through indirect heat exchange.

12. A dispersing and grinding apparatus according to claim 11; including another heat exchanging means disposed interiorly of the rotor for controlling the temperature of the material being processed through indirect heat exchange.

13. A dispersing and grinding apparatus according to claim 1; wherein the guiding means comprises a plurality of guide members, each guide member having a forward guide surface and a rearward guide surface.

14. A dispersing and grinding apparatus according to claim 13; wherein the forward and rearward guide surfaces of the respective guide members are parallel to one another.

15. A dispersing and grinding apparatus according to claim 14, wherein the forward and rearward guide surfaces of all the guide members are parallel to one another.

16. A dispersing and grinding apparatus according to claim 13; wherein the forward and rearward guide surfaces are distributed in a uniform pattern.

17. A dispersing and grinding apparatus according to claim 1; wherein the forward and rearward guide surfaces lie along imaginary helices of the same pitch.

* * * * *